US005093960A

United States Patent [19]

Pemberton

[11] Patent Number: 5,093,960

[45] Date of Patent: Mar. 10, 1992

[54] WINDOW HINGE HAT

[75] Inventor: Whitley Pemberton, Owatonna, Minn.

[73] Assignee: Truth Division of SPX Corporation, Owatonna, Minn.

[21] Appl. No.: 722,307

[22] Filed: Jun. 27, 1991

[51] Int. Cl.[5] ..... E05D 11/06; E05D 15/32

[52] U.S. Cl. ..... 16/360; 16/370; 16/371

[58] Field of Search ..... 16/360, 363, 368-371, 16/355, 374; 49/248, 250

[56] References Cited

U.S. PATENT DOCUMENTS

| | | | |
|---|---|---|---|
| 3,797,169 | 3/1974 | Armstrong . | |
| 4,674,149 | 6/1987 | Vetter . | |
| 4,689,852 | 9/1987 | Buckley . | |
| 4,718,144 | 1/1988 | Buckley . | |
| 4,823,508 | 4/1989 | Allen . | |
| 4,833,754 | 5/1989 | Yang | 16/371 |

FOREIGN PATENT DOCUMENTS

| | | | |
|---|---|---|---|
| 2081803 | 2/1982 | United Kingdom | 16/370 |
| 8800638 | 1/1988 | World Int. Prop. O. | 16/370 |

*Primary Examiner*—Robert L. Spruill
*Assistant Examiner*—Carmine Cuda
*Attorney, Agent, or Firm*—Wood, Phillips, Mason, Recktenwald & Vansanten

[57] ABSTRACT

A window hinge assembly for mounting a window sash to a window frame including an elongated track mountable along an axis to the window frame and a generally planar sash arm mountable along an axis to the window sash. The sash arm is also mounted for movement in a plane parallel to the track axis and has one end positionable adjacent one track end when the window sash is closed. A pair of mirror image hat members are interchangeably attachable separately to the arm one end and the track one end, where each of the hat members have a base selectively securable to the arm and the track and a perpendicularly bent edge on one end. The hat member bases are trapezoidal and attached to the arm and track so that the outwardly facing base side is shorter than the parallel opposite base side, with the bent edge protruding perpendicularly from the base.

10 Claims, 2 Drawing Sheets

Fig. 1
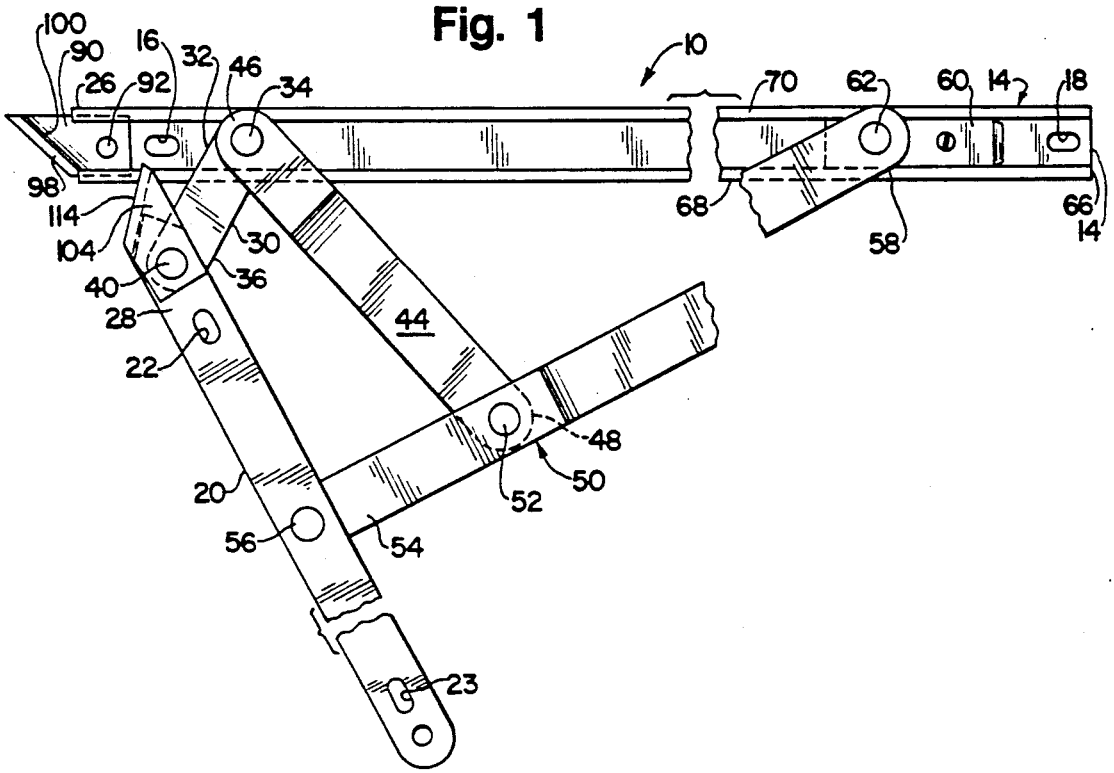
Fig. 7
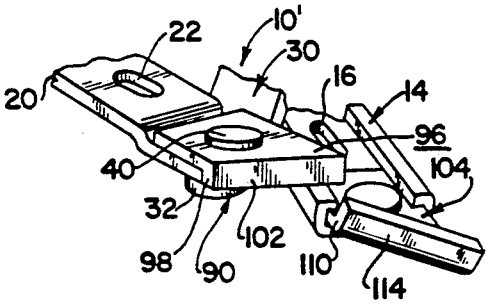
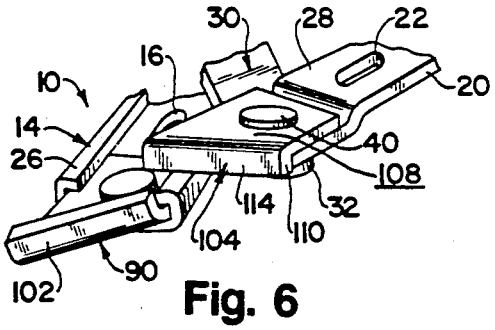
Fig. 6

Fig. 2
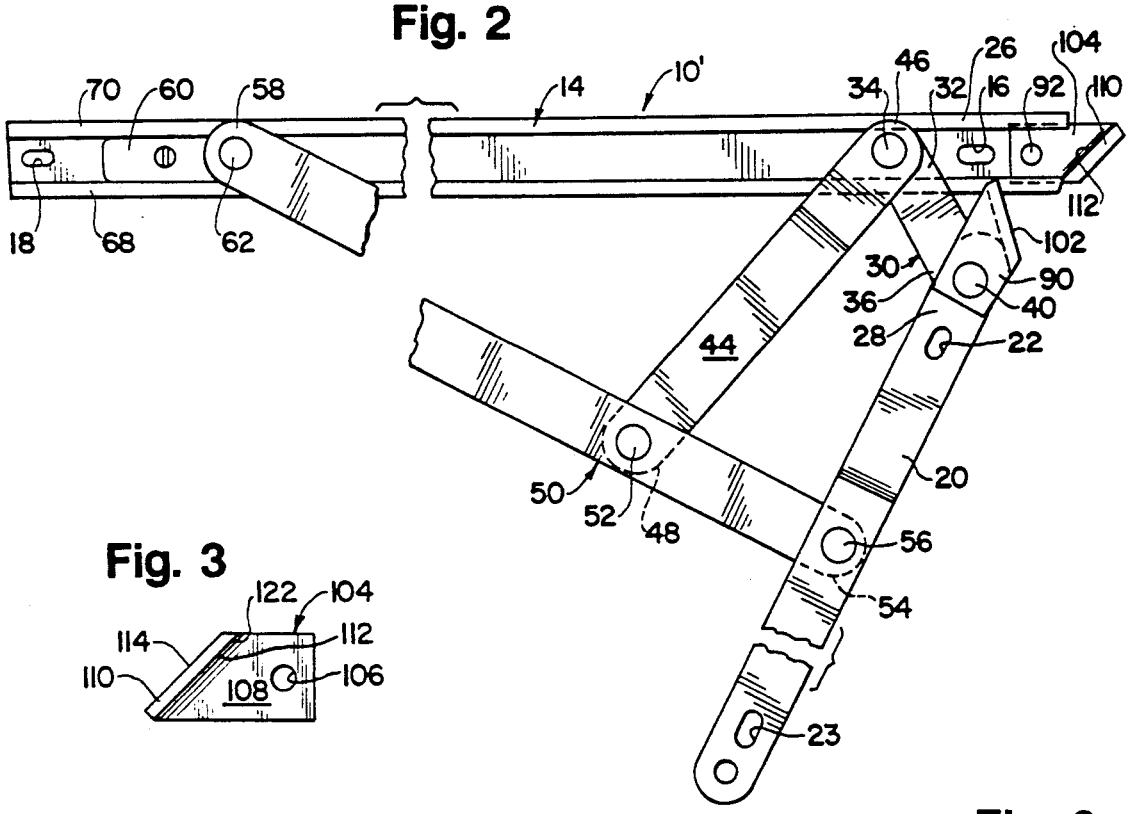
Fig. 3
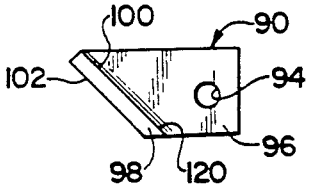
Fig. 4
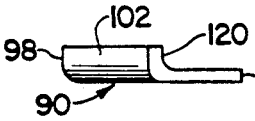
Fig. 5
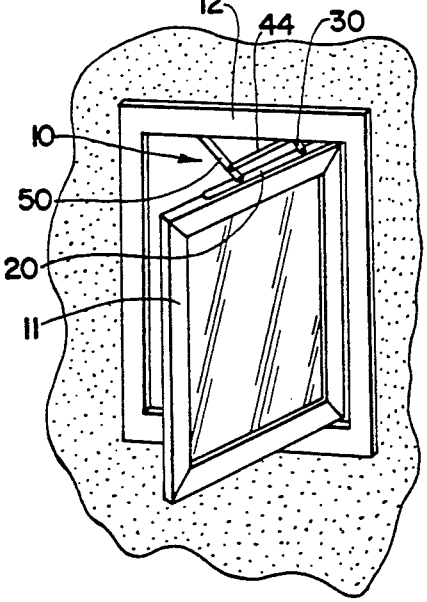
Fig. 9
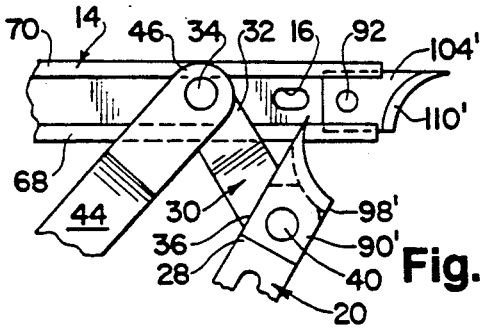
Fig. 8

WINDOW HINGE HAT

BACKGROUND OF THE INVENTION

1. Technical Field

The present invention is directed toward window hinges, and more particularly toward a unique design for a hat design for ensuring proper alignment of the hinge sash arm and links with the hinge track when closed.

2. Background Art

Window hinges are known in the art for providing pivotal movement of a window between a closed position (with the window sash sealed against the window frame) and an open positions (with the window sash usually projecting out of the room in which the window is located). Window hinges typically involve an elongated track mountable to a window frame, a sash arm mountable along to a window sash, and a plurality of links pivotally interconnecting the sash bar with the track so that the sash bar is movable in a plane. Typically it is desirable for the track, sash arm, and links to all be aligned when the window sash is closed, as misaligned components can result in long term bending stresses on pivots which in turn can result in bending and undesirable binding during operation of the hinge.

To achieve alignment of the links and sash arm with the track, some window hardware manufacturers mold a separate component of zinc or plastic to go into the track or the sash bar that are designed specifically for left- or right-handed hinges. Since both types of hinges are required, the requirement of separate, distinctive parts of such different operating hinges can create additional costs for manufacturing and storage. Individual tools or molds may be required to produce each the separate components, thereby increasing the cost of those components. Further, undesirable (and costly) delays can result where the wrong hinges (i.e., left-handed hinges where right-handed hinges are required, and vice versa) are supplied to a site during installation.

U.S. Pat. No. 4,674,149 shows a particular hat design which has been used to ensure alignment of the hinge components when the sash is closed. This design includes a V-shaped hat secured to the end of the track and interacting with a V-shaped cam surface on the end of the sash bar during closing of the window to align the sash bar and links with the track. Such a hat configuration can operate adequately, although manufacture and operational problems can arise. Specifically, the V-shaped hat can be relatively expensive to make from metal components. Further, while such hats can be relatively inexpensively made of hard plastic, those hats are less able to withstand high stresses which can occur occasionally with any window installation, particularly in view of the high stress concentrations occurring at narrow engagement of the hat with the end of the sash bar. Still further, while the V-shaped hat design can be used in both right-handed and left-handed hinges, it unavoidably provides less strength when installed, inasmuch as in any given installation only one side of the "V" functions to guide and maintain the sash bar in alignment with the links.

The present invention is directed toward overcoming one or more of the problems set forth above.

SUMMARY OF THE INVENTION

In one aspect of the present invention, a window hinge assembly for mounting a window sash to a window frame is provided, including an elongated track mountable along an axis to the window frame and a generally planar sash arm mountable along an axis to the window sash. The sash arm is also mounted for movement in a plane parallel to the track axis and has one end positionable adjacent one track end when the window sash is closed. A pair of hat members are interchangeably attachable separately to the arm one end and the track one end, where each of the hat members have a base selectively securable to the arm and the track and a perpendicularly bent edge on one end.

In another aspect of the present invention, the window sash is supported for opening outwardly. Each of the hat members are mirror images to one another, and include a trapezoidal base selectively attachable to the arm and track with the outwardly facing base side longer than the parallel opposite facing base side, and a capturing end between the sides and protruding perpendicularly from the base.

It is an object of the invention to simplify the construction of hinges by minimizing the number of parts needed to make both left-handed and right-handed hinges. It is therefore a related object of the present invention to avoid the additional manufacturing and inventory costs commonly encountered where different parts must be manufactured for different installations.

It is a further object of the present invention to provide a hinge which may be easily assembled in the field, and to still further allow use of hinges which may be adapted in the field for either right or left hand pivoting according to the needs of the installation.

It is yet another object of the present invention to provide a window hinge which ensures proper alignment to seal the window sash against the window frame when the window sash is closed.

Another object of the present invention include the provision of a strong hinge which will reliably withstand the sometimes great forces which are encountered during operation.

Still another object of the present invention is the provision of a window hinge which can be easily and inexpensively manufactured.

Yet another object of the present invention is the provision of a window hinge which will reliably close a supported window sash throughout the long life of any window installation. It is therefore a related object of the present invention to prevent significant energy losses which can occur with improperly sealed windows.

BRIEF DESCRIPTION OF THE DRAWINGS

FIG. 1 is a plan view of a hinge embodying the present invention;

FIG. 2 is a plan view of a hinge pivotable in the direction opposite to that of the FIG. 1 hinge;

FIG. 3 is a plan view of one hat member of a preferred embodiment of the present invention;

FIG. 4 is a plan view of the other hat member of the FIG. 3 embodiment;

FIG. 5 is a side view of the other hat member shown in FIG. 4;

FIG. 6 is a partial perspective view of the FIG. 1 hinge during closing of the hinge;

FIG. 7 is a partial perspective view of the FIG. 2 hinge during closing of the hinge;

FIG. 8 is a plan view of a portion of a hinge embodying an alternative embodiment of the present invention; and FIG. 9 is a perspective view of a window sash supported on a window frame by hinges embodying the present invention.

DESCRIPTION OF THE PREFERRED EMBODIMENT

A hinge assembly 10 for mounting a window sash 11 to a window frame 12 (see FIG. 9) for controlling the opening and closing of the window is shown in FIG. 1. The window hinge 10 has a longitudinal track 14 that is mountable to a window frame by suitable fasteners such as screws through holes 16 and 18. Arm 20 is mountable along an axis to a window sash by suitable fasteners such as screws through holes 22 and 23. Though not shown, a track first end 26 is positioned adjacent a sash arm first end 28, when the window is in a closed position.

The sash arm 20 is pivotally connected to the track 14 by a suitable link structure. For example, as shown in FIGS. 1 and 2, a first link 30 is pivotally connected at one end 32 to the track 14 adjacent the track first end 26 by suitable means, such as a rivet 34. The opposite end 36 of the first link 30 is pivotally connected to the sash arm first end 28 by suitable means, such as the rivet 40 shown.

A second link 44 is pivotally connected at a first end 46 to the track 14 at the same point as the first link 30 by means of the rivet 34. The opposite end 48 of the second link 44 is pivotally connected at an intermediate point along a third link or strut 50 by means of a rivet 52.

The third link 50 is pivotally connected at one end 54 to an intermediate point of the sash arm 20 by suitable means, such as a rivet 56. The opposite end 58 of the third link 50 is pivotally connected to a shoe or slider 60 by suitable means, such as the illustrated rivet 62. The track 14 includes sides 68 and 70 which partially fold over to ensure that the shoe 60 will be securely retained in the track 14 throughout its range of sliding motion.

The foregoing arrangement allows the sash arm 20 to move in a plane parallel to the track 14, as is required for proper operation of the hinge 10 for movement of the window sash 11 relative to the window frame 12.

Referring now to the present invention, a hinge having a capturing member or hat member 90 suitably connected to the track first end 26 (for example, by the illustrated rivet 92 through hole 94 [see FIG. 4]) is shown in FIG. 1. The hat member 90, which is preferably made of strong sheet metal or the like, has a trapezoidal base 96 with a suitably formed perpendicularly bent portion 98 (as by stamping the sheet metal), where the line of the bend is skewed at an angle, preferably about 45°. The bent portion 98 defines an inner surface 100 and an outer surface 102, and the shorter of the parallel base sides is disposed on the side of the track 14 beyond which the sash arm 20 moves.

A second capturing member or hat member 104 is suitably connected to the sash arm first end 28, for example, by the rivet 40 (FIG. 1) through hole 106 (see FIG. 3). As shown in FIG. 3, the second hat member 104 is essentially a mirror image of the first hat member 90, and therefore is also preferably made of strong sheet metal or the like stamped to include a trapezoidal base 108 and a perpendicularly bent portion 110. The bent portion 110 is skewed at an angle, preferably about 45°, though in the opposite direction of the skew of the first hat member bent portion 98. The second hat member bent portion 98 defines an inner surface 112 and an outer surface 114, and the shorter of the parallel base sides is disposed on the side of the track 14 beyond which the sash arm 20 moves.

Preferably, the hat members 90, 104 are secured to the track 14 and sash arm 20 respectively so that, when the hinge 10 is fully closed (with the sash arm 20 and three links 30, 44, 50 in alignment with the track 14), the outer surface 114 of the sash arm hat member 104 engages the inner surface 100 of the track hat member 90.

While the bent portions 98, 110 of the hat members 90, 104 are illustrated as being essentially straight (as these can be most easily and inexpensively manufactured), it should be understood that the bent portions could also have another shape, such as the concave bent portions 98', 110' of the hat members 90', 104' shown in FIG. 8, to achieve the same results.

FIG. 1 shows a hinge 10 wherein the sash arm 20 supports a window sash (not shown) which may be opened outwardly (down in FIG. 1) and essentially pivots about the right side of the sash as viewed from the inside of the room (the top in FIG. 1).

FIG. 2 shows a virtually identical hinge 10' except that it pivots in the opposite direction. In the FIG. 2 configuration, the hat members 90, 104 are secured to the sash arm 20 and track 14 respectively so that, when the hinge 10' is fully closed (with the sash arm 20 and three links 30, 44, 50 in alignment with the track 14), the outer surface 102 of the sash arm hat member 90 engages the inner surface 112 of the track hat member 104.

As will be apparent to those having an understanding of the present invention, the FIG. 2 hinge 10' may be located on the top of a right-hand opening sash supported on the bottom by the FIG. 1 hinge 10. By contrast, for left-handed opening, the hinges 10, 10' can be reversed, With the FIG. 2 hinge 10' on the bottom of the sash 11 and the FIG. 1 hinge 10 on the top of the sash 11.

As can be seen from an examination of FIGS. 1 and 2, the two hinges 10 and 10' are identical except for the hat members 90, 104, which are also identical except that they are switched (i.e., the hat member 90 on the track 14 in FIG. 1 is on the sash arm 20 in FIG. 2, and the hat member 104 on the sash arm 20 in FIG. 1 is on the track 14 in FIG. 2). Accordingly, no different components are required in order to manufacture hinges which operate in opposite directions as is required in virtually all installations. Thus, the additional manufacturing and inventory costs commonly encountered where different parts must be manufactured for different installations are avoided Further, this hat member structure may be easily assembled in the field by use of simple rivets, since "universal" hinges (operable for either right or left hand pivoting) can be provided without the hat members secured thereon, and the installer can attach the hat members 90, 104 in whichever configuration is required for the installation.

Still further, these advantages are all achieved with a resultant hinge structure which provides ideal operation to ensure that the window sash is properly aligned in the frame when closed.

Specifically, as best illustrated in FIG. 6 with respect to the FIG. 1 hinge 10, as a window sash is closed (to bring the sash arm 20 into alignment with the track 14), the forward end of the sash arm hat member bent portion 110 is caught behind the track hat member bent portion 98. Thus, during continued closing of the sash, the outer surface 114 of the sash arm hat member bent portion 110 essentially slides along the rear edge 120 (see FIGS. 4–5) of the track hat member bent portion 98 until, when fully closed, the outer surface 114 of the sash arm hat member bent portion 110 abuts the inner surface 100 of the track hat member bent portion 98.

Similarly, as illustrated in FIG. 7 with respect to the FIG. 2 hinge 10', as a window sash is closed (to bring the sash arm 20 into alignment with the track 14), the forward end of the sash arm hat member bent portion 98 is caught behind the track hat member bent portion 110. Thus, during continued closing of the sash, the outer surface 102 of the sash arm hat member bent portion 98 essentially slides along the rear edge 122 (see FIG. 3) of the track hat member bent portion 110 until, when fully closed, the outer surface 102 of the sash arm hat member bent portion 98 abuts the inner surface 112 of the track hat member bent portion 110.

Thus, this structure "captures" the sash arm 20 to ensure that it and the links 30, 44, 50 will all be in alignment with the track 14, as is desired, when the window sash is closed. Further, the hat members 90, 104 will reliably withstand the sometimes great forces which are encountered during such operation, since such members can be inexpensively manufactured of strong sheet metal (as opposed to many prior art hat structures, which could not be easily manufactured from such materials and therefore required use of much weaker plastic components). Still further, since this hinge structure will provide reliable operation in fully and properly closing a supported window throughout the long life of any window installation, significant energy savings can also accrue over that long life (by avoiding energy loss which naturally occurs with improperly sealed windows).

Still other aspects, objects, and advantages of the present invention can be obtained from a study of the specification, the drawings, and the appended claims.

I claim:

1. A window hinge assembly for mounting a window sash to a window frame, comprising:

an elongated track mountable along an axis to the window frame;

a generally planar sash arm mountable along an axis to the window sash;

means for mounting said sash arm for movement in a plane parallel to said track axis, wherein said sash arm has one end positionable adjacent one track end when said window sash is closed; and a pair of capturing members interchangeably attachable separately to said arm one end and said track one end, each of said capturing members having a base selectively securable to the arm or the track, and a perpendicularly bent edge on one end.

2. The hinge assembly of claim 1 wherein said capturing members are mirror images to one another, with the capturing members being attached to the track and sash arm with their bent edges skewed relative to the associated track and sash axes and projecting toward the base of the other capturing member when the window sash is closed.

3. The hinge assembly of claim 1 wherein each of said capturing members is made of stamped sheet metal.

4. The hinge assembly of claim 1 wherein said mounting means comprise a plurality of pivoting links.

5. The hinge assembly of claim 1 further comprising:

a first link connected at one end to a track pivot adjacent said track one end and connected at a second end to said sash arm one end;

a second link pivotally connected at one end to said track pivot;

a third link connected at one end to an intermediate sash arm pivot and at an intermediate third link pivot to the second link other end; and a shoe movable along said track adjacent the track other end and pivotally supporting said third link other end.

6. In a window hinge assembly having a track mountable along an axis to a window frame, an arm mountable along an axis to a window sash, and a plurality of links interconnecting said track and said arm for movement of said arm in a plane generally parallel to said track axis, said arm and said links being alignable with said track when said window sash is closed against said window frame, means for capturing said arm in alignment with said track comprising:

first and second capturing members interchangeably attachable to the ends of said arm and said track, wherein when said first capturing member is attached to said track and said second capturing member is attached to said arm, said arm is captured from one side of said track, and when said first capturing member is attached to said arm and said second capturing member is attached to said track, said arm is captured from the opposite side of said track.

7. The hinge assembly of claim 6 wherein:

said window sash is supported for opening outwardly;

each of said capturing members comprises a trapezoidal base selectively attachable to a track first end and an arm first end, wherein the outwardly facing base side is shorter than the parallel opposite base side, and a capturing end between said sides and protruding perpendicuarly from said base; and said capturing members are mirror images to one another.

8. A hinge assembly for a window comprising:

an elongated track mountable to a window frame;

a sash arm mountable to a window sash and supported for movement in a plane parallel to said track;

a first hat member interchangeably mountable to said frame or arm; and a second hat member interchangeably mountable to whichever of said arm or frame to which said first hat member is not mounted, said second hat member being the mirror image of the first hat member;

wherein said first and second hat members nest together to align said track and sash arm together when said window sash is closed against said window frame.

9. The hinge assembly of claim 8 wherein said hat members each comprise a base with a bent portion protruding perpendicularly relative said base.

10. The hinge assembly of claim 9 wherein said window sash is supported for opening outwardly and each of said hat members comprises a trapezoidal base selectively attachable to a track first end and a sash arm first end, wherein the outwardly facing base side is shorter than the parallel opposite base side, and said bent portion extends between said sides.

* * * * *